US006302183B1

(12) United States Patent
Judkins et al.

(10) Patent No.: US 6,302,183 B1
(45) Date of Patent: Oct. 16, 2001

(54) VENETIAN TYPE BLIND HAVING LENGTH ADJUSTABLE BOTTOMRAIL

(76) Inventors: Ren Judkins, 46 Newgate Rd., Pittsburgh, PA (US) 15202; Michael Kollman, 805 Ondossagon, Madison, WI (US) 53719; Cletis F. Swopes, 9 Loomis Cir., Apartment 7, Madison, WI (US) 53704

( * ) Notice: Subject to any disclaimer, the term of this patent is extended or adjusted under 35 U.S.C. 154(b) by 0 days.

(21) Appl. No.: 09/632,178

(22) Filed: Aug. 3, 2000

Related U.S. Application Data

(62) Division of application No. 09/035,489, filed on Mar. 5, 1998, now Pat. No. 6,119,757.

(51) Int. Cl.[7] ..... E06B 9/30
(52) U.S. Cl. ..... 160/178.1 R; 160/173 R
(58) Field of Search ..... 160/168.1 R, 176.1 R, 160/173 R, 405, 177 R, 178.1 R; 29/24.5

(56) References Cited

U.S. PATENT DOCUMENTS

| | | | | |
|---|---|---|---|---|
| 2,459,517 | | 1/1949 | Gearhart . | |
| 2,486,492 | | 11/1949 | Redman . | |
| 2,491,181 | | 12/1949 | Hunter . | |
| 2,560,858 | | 7/1951 | Grogan . | |
| 2,579,485 | | 12/1951 | Ferguson et al. . | |
| 2,589,147 | | 3/1952 | Schaefer . | |
| 2,652,112 | | 9/1953 | Walker . | |
| 2,662,261 | | 12/1953 | Mikoski . | |
| 4,177,853 | | 12/1979 | Anderson et al. . | |
| 4,441,540 | | 4/1984 | Tsuhako . | |
| 4,525,907 | * | 7/1985 | Tachikawa | 29/24.5 |
| 4,886,102 | | 12/1989 | Debs . | |
| 4,958,421 | * | 9/1990 | Spangenberg | 29/24.5 |
| 5,573,051 | | 11/1996 | Judkins . | |
| 5,655,590 | * | 8/1997 | Bryant | 160/168.1 R |
| 5,765,621 | | 6/1998 | Bryant . | |
| 5,918,656 | * | 7/1999 | Daniels et al. | 160/168.1 R |
| 5,947,176 | * | 9/1999 | Judkins | 160/168.1 R |
| 6,119,757 | * | 9/2000 | Judkins et al. | 160/173 R X |

FOREIGN PATENT DOCUMENTS

| | | |
|---|---|---|
| 1 252 878 | 10/1967 | (DE) . |
| 1 509 182 | 12/1968 | (DE) . |

* cited by examiner

*Primary Examiner*—David M. Purol
(74) *Attorney, Agent, or Firm*—Buchanan Ingersoll, P.C.

(57) ABSTRACT

A venetian type blind has a length adjustable bottomrail to fit windows of different lengths. The bottomrail has a channel at each ladder location through which the lift cords and the cord rails pass. A separate channel can also provided for the lift cord. An opening is provided in the underside of the bottomrail at each ladder location and an insert is disposed therein. The lift cord passes through the channel and attaches to the insert. The cord rails pass through the channel and out through the opening. The insert has a head portion with a bore therein. A threaded plug is installed in the bore. The head portion preferably has a rim portion with apertures through which the cord rails can pass. The threaded plug preferably has a cap portion and a pocket therein for storing the ends of the cord rails. Alternatively, the threaded plug is inserted into the opening itself. To adjust the length of a blind having this length adjustable bottomrail, two slats at the desired length are clamped together and the excess slats are removed. The empty rungs are cut through the middle. The threaded plug is loosened and slack in the cord rails is taken up by pulling the cord rails through the opening in the bottomrail. The excess length is cut off and the ends of the cord rails are stored in the pocket in the cap portion.

5 Claims, 8 Drawing Sheets

VENETIAN TYPE BLIND HAVING LENGTH ADJUSTABLE BOTTOMRAIL

CROSS REFERENCE TO RELATED APPLICATION

This application is a divisional application of U.S. patent application Ser. No. 09/035,489, filed Mar. 5, 1998, now U.S. Pat. No. 6,119,757.

FIELD OF INVENTION

The invention relates generally to a venetian type blind, and more particularly to a venetian type blind having a length adjustable bottomrail for customizing the length of the blind to fit windows of different lengths.

BACKGROUND OF THE INVENTION

Venetian type blinds have a series of slats hung on ladder cords which extend from a headrail to a bottomrail. Depending upon the width of the blind, two or more lift cords are provided. Usually, each lift cord is attached at one end to the bottomrail. The lift cords pass through elongated holes in the slats up to and through the headrail. A cord lock is usually provided in the headrail through which the lift cords pass. The cord lock allows the user to maintain the blind in any desired position from fully raised to fully lowered. The slats rest on rungs between the rails of the ladder cords. The blind is in an open position when the rungs are horizontal. To close most venetian blinds one lifts one rail while allowing the other rail to either remain in place or be lowered. Both the lift cords and the ladder cords are typically nonadjustably connected to the bottomrail.

In U.S. Pat. No. 5,573,051, there is shown a venetian type blind having slats that are notched to form slots on their inside edge and outside edge to accommodate the lift cords. The lift cords pass from the bottomrail to the headrail each passing through a slot on the inside edge or outside edge of each slat. At least two cord-type ladders are provided to hold the slats and are aligned such that the rails of the ladders are adjacent the lift cords and outside the slots cut in the slats. The slots are sized so that the lift cords and the ends of the rungs can loosely fit therein. Because lift cords travel within the slots provided in the slats no cord holes are needed in the slats.

It is known to customize venetian type blinds to fit windows of different sizes. Generally, a standard width blind which is closest to, but wider than, the window is selected to be modified. The headrail, bottomrail and slats are trimmed to fit the width of the window. To maintain symmetry, an equal amount is usually trimmed from each end of the slats. Since the length of the blind is adjustable by simply operating the lift cords, the length of the blind sometimes is not modified. Instead, a standard size blind which is nearest to, but longer than, the length of the window is chosen and the extra length is stacked on the bottomrail which rests on the window sill. However, this arrangement can be aesthetically unappealing and comprises the blinds closure when tilted. Equally unappealing is to simply remove the slats because the portion of the ladders which supported the removed slats would still remain. For the best appearance the blind should be nearly the same length as the window when fully extended. Any change in length must shorten the ladders as well as remove slats.

In venetian type blinds the rails of ladders, which typically are cords but could be tape, and the lift cords can be attached to the bottomrail in different ways. One manner of attaching a ladder tape to a bottomrail is shown in U.S. Pat. No. 2,652,112 to Walker wherein the lift cord passes through small openings in the middle of each slat. The bottomrail has a hole completely through the top and the bottom surfaces. The opening in the top surface of the bottomrail is slightly narrower than the opening in the bottom surface. The lift cord is inserted through the narrower opening and a knot is formed in the end so that it cannot be pulled back through the narrower opening. The rails of the tape ladder encompass the bottomrail. A channel is provided longitudinally along one side of the bottomrail into which a portion of the tape rail can be folded. A pin is then inserted into the longitudinal channel over the tape rail to frictionally hold the tape rail to the longitudinal channel.

Anderson et al. in U.S. Pat. No. 4,177,853 show a manner of connecting the lift cord and a ladder cord to the bottomrail. In Anderson, the bottomrail has a longitudinal channel provided along the upper surface and a hole provided in the lower surface for each lift cord. A plug is provided in each hole. Each lift cord passes through small openings in the center of each slat, through the longitudinal channel and is connected to a plug. The cord rails pass outside of and adjacent to each side of the bottomrail and are then inserted up through the hole in the lower surface. The cord rails are frictionally held in the opening by the plug. Similarly, to Anderson, German Patent Nos. 1 252 878 and 1 509 182 each disclose a manner of attaching a lift cord and ladder cords to a bottomrail wherein a longitudinal channel is provided in the upper surface of the bottomrail and a hole is provided in the lower surface. In each case the lift cord passes through small openings in the middle of each slat, through the longitudinal channel and attaches to the plug. The cord rails pass outside of and adjacent to each side of the bottomrail and are then inserted up through the hole in the lower surface. The plug frictionally retains the cord rails in the hole. In each case the plug is frictionally retained in the hole and/or is held therein because of the attachment to the lift cord.

Theoretically, the bottomrails described in Anderson and the two German patents could be adjusted for the length of the blinds by removing excess slats, removing the plug, cutting off the excess slack in the cord rails, reinserting the ends of the cord rails up through the hole in the underside of the bottomrail, and then reinserting the plug to hold the cord rails in place. However, one problem with such a procedure is that repeated removal and insertion of the plug results in the fit between the hole and the plug becoming looser such that the cord rails may not be securely held in the hole. Another is that it takes a significant amount of time for the novice.

Accordingly, there is a need for venetian blind having a bottomrail that is readily adjustable so that the blind can be easily customized to fit windows of different lengths. Such a blind should overcome the disadvantages in the prior art by eliminating the stack of excess slats on the bottomrail and the excess ladder portions. Such a blind should permit repeated disconnection and reconnection of the lift cords and ladders without loosening or otherwise deteriorating the connections.

SUMMARY OF THE INVENTION

I provide a venetian type blind having an adjustable bottomrail, headrail and plurality of slats positioned therebetween. The bottomrail is easily and quickly adjusted in length so that the blind can be customized to fit windows of different lengths. At least two lift cords pass from the bottomrail to the headrail. At least two preferably cord-type ladders are provided to hold the slats. The ladders are aligned such that each lift cord is adjacent one ladder. The lift cords preferably pass outside the edges of the slats similarly to the ladder rails. However, the lift cords can also be of the type which pass through small openings in the slats. The bottomrail is length adjustable so that the cord ladders can be shortened to take up slack when the length of the blind is altered and then reconnected afterwards to give the customized blind a finished appearance.

An opening is provided in the underside of the adjustable bottomrail and a threaded plug is disposed in the opening. For venetian type blinds in which the lift cords pass outside of the edges of the slats a transverse horizontal channel is provided through the adjustable bottomrail. At least one channel communicates with each opening in the bottomrail. Each lift cord is inserted through a horizontal channel and attached to a threaded plug. The cord rails are also inserted through the horizontal channel but continue out through the opening in the bottomrail along the outer sides of the threaded plug. For venetian type blinds in which the lift cords pass through small openings in the slats a vertical channel can also be provided through the upper side of the bottomrail. The vertical channel provides access to the plug for the lift cord(s). The cord rails are routed along the same path as described above but the lift cords are inserted through the vertical channel to be attached to the threaded plug.

Alternatively, instead of inserting the threaded plug directly into the opening in the bottomrail, an insert can be provided which has a post portion that is fitted into the opening. The insert also has a head portion and a bore in the head portion into which the threaded plug can be installed. Thus, the insert is first fitted into the opening and then the threaded plug is installed in the bore in the insert. The cord rails pass through the horizontal channel, along the sides of the post portion and out the opening in the bottomrail. The head portion can have a rim portion which has small apertures through which the cord rails pass as they exit the opening along the sides of the post portion. Furthermore, the threaded plug can have a cap portion and a pocket in the cap portion into which the ends of the ladder cord rails can be inserted to give the blind a more appealing "finished" appearance.

We also provide a method of adjusting the length of a blind using our length adjustable bottomrail. In the method a window blind of approximately the same length as the window, but longer, is initially chosen. Two slats at the desired adjusted length are clamped together so that the ladder rungs are between them. Next, the rungs where all the slats to be removed are cut through the middle. Then, all of the slats between the clamped slats and the bottomrail are removed. The threaded plug is then loosened and the slack in the cord rails is taken up by pulling the cord rails through the horizontal channel and out the opening in the bottomrail. The cap is tightened, the excess length is cut off and the free ends of the cord rails are pushed into the pocket in the cap portion of the threaded plug to give the blind a finished appearance.

Other objects and advantages of the present invention will become apparent from a description of the present preferred embodiments shown in the drawings.

DESCRIPTION OF THE PREFERRED EMBODIMENTS

Figure 1:
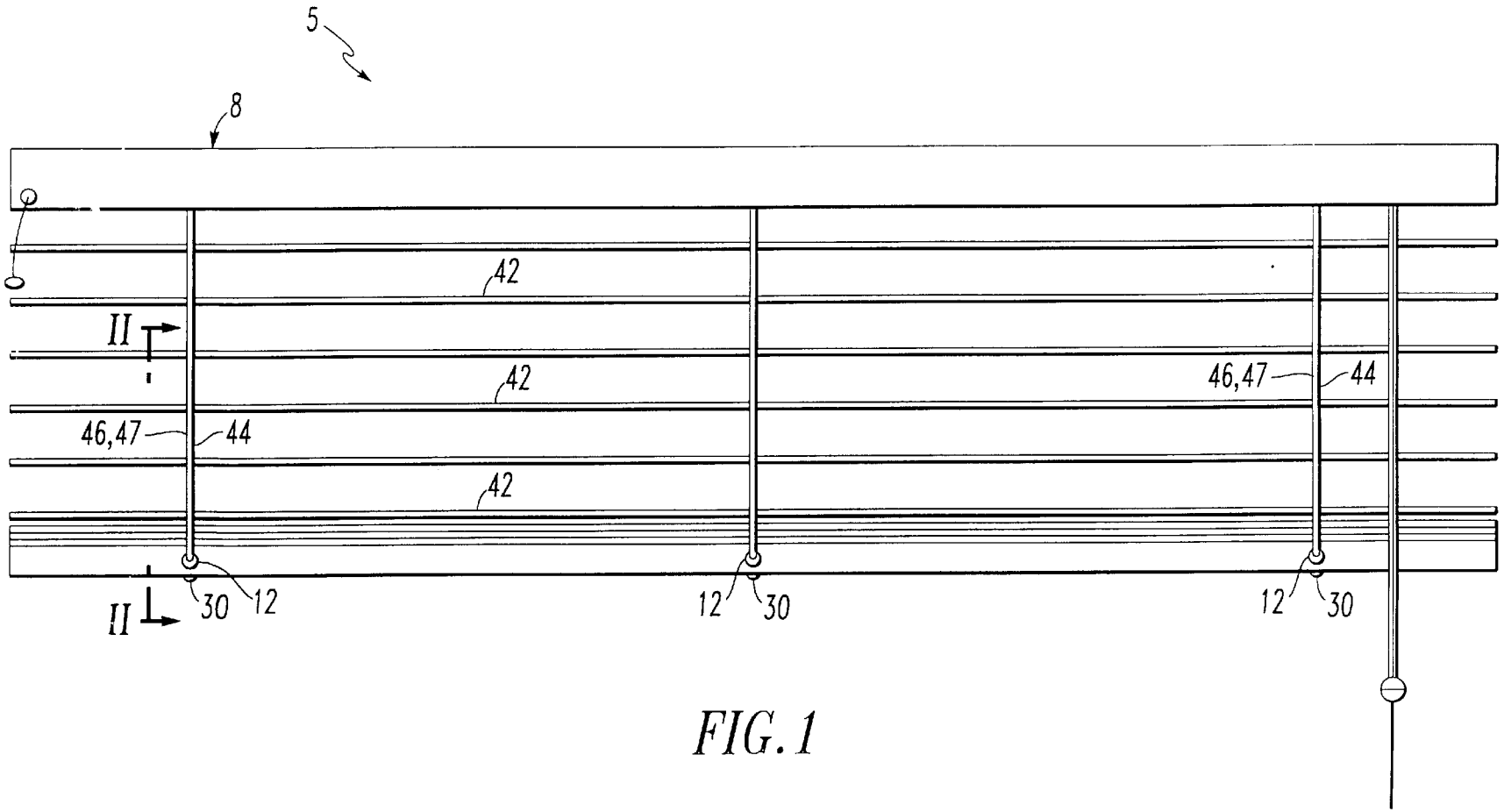
FIG. 1 is a front view of the present preferred embodiment of our venetian type blind shown in a lowered open position.
Figure 2:
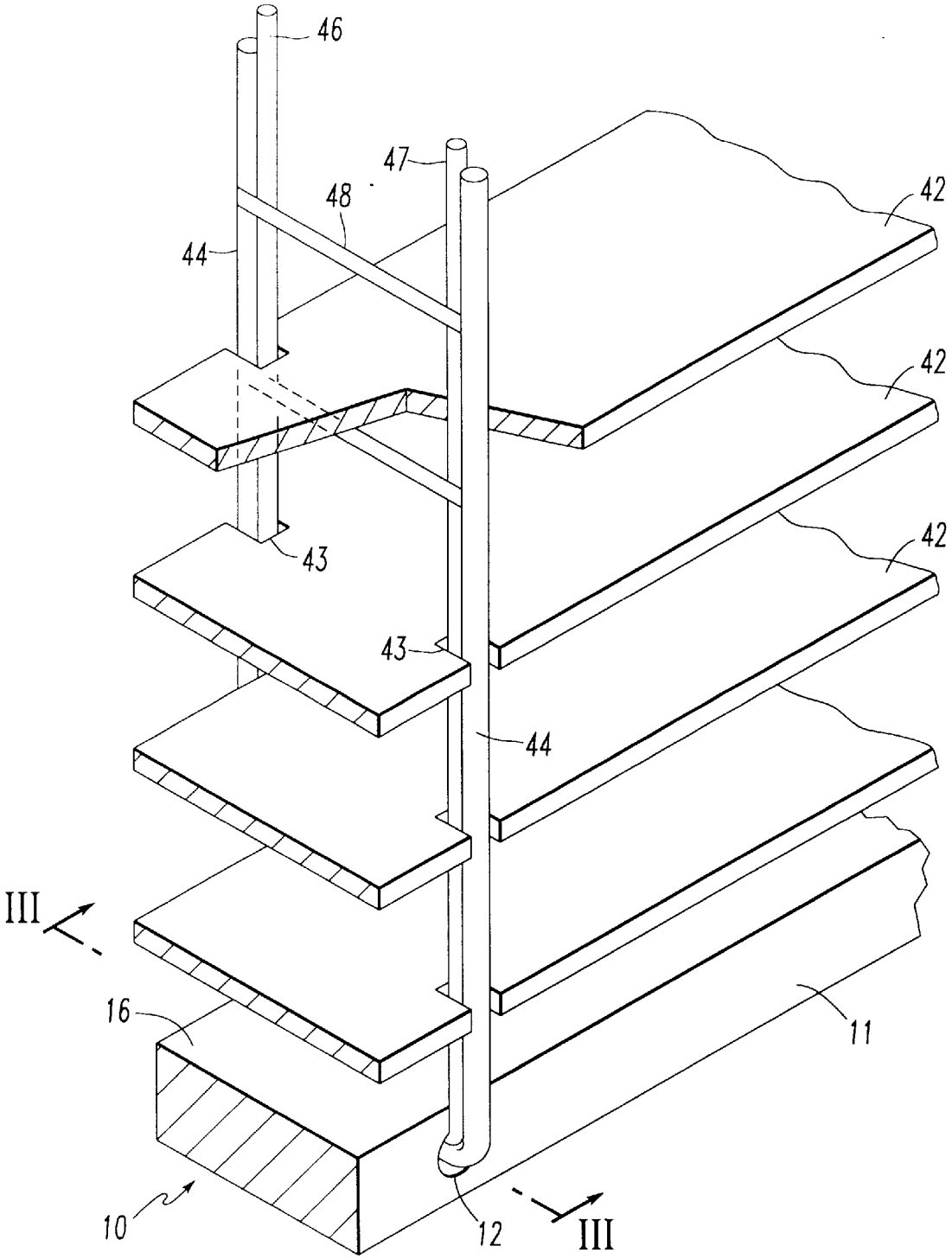
FIG. 2 is a perspective view taken along line II—II in FIG. 1.

The first presently preferred embodiment of our venetian type blind 5 shown in FIG. 1 has a headrail 8, a length adjustable bottomrail 10 and a set of slats 42 extending therebetween. For purposes of illustration only six slats 42 are shown. However, the blind 5 could have any number of slats and would likely have many more slats than are shown. As shown in FIG. 2, the slats 42 are suspended on a cord-type ladder having cord rails 44 and rungs 48 extending between the cord rails 44 on which the slats 42 rest. Lift cords 46, 47 are provided between the headrail 8 and the bottomrail 10 to raise or lower the blind 5. In this embodiment a lift cord is provided on both sides of the slats 42 of selected ladders. An alternate cording arrangement can be used wherein a single lift cord would be provided at each selected ladder on alternate sides of the slats 42 along the width of the blind 5. For example, in the blind shown in FIG. 1, at the far left side of the blind 5 only the rear lift cord is provided. Then, in alternating fashion only a front lift cord is provided at the center ladder of the blind 5 and only a rear lift cord is provided against the far right ladder. Preferably, the lift cords pass through notches 43 provided in the edges of each slat. The rails of the ladders pass into the bottomrail 10 through channels 12 and are secured by plugs 30.

Figure 3:
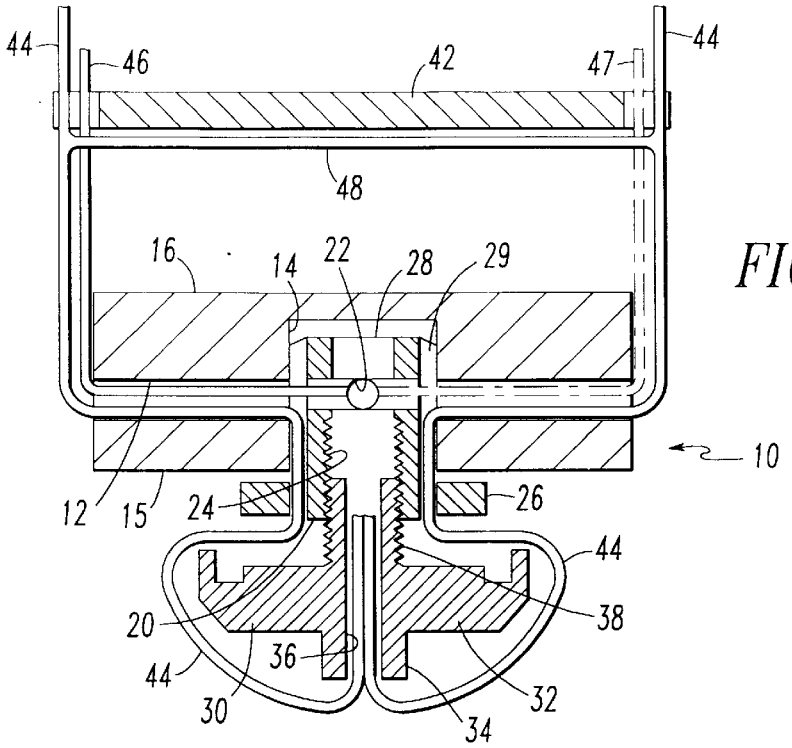
FIG. 3 is a sectional view taken along the line III—III in FIG. 2.
Figure 4:
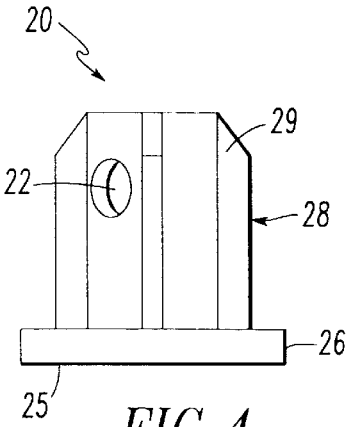
FIG. 4 is a side view of a first present preferred insert.
Figure 5:
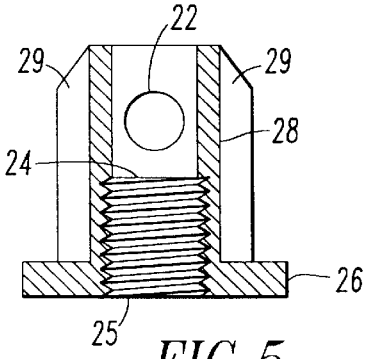
FIG. 5 is a cross sectional view of the insert shown in FIG. 4.
Figure 6:
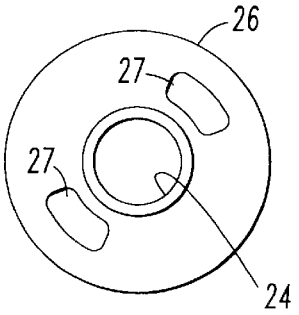
FIG. 6 is a bottom plan view of the insert shown in FIG. 4.

Referring to FIG. 3, the length adjustable bottomrail 10 has an opening 14 provided in the underside 15 in which an insert 20 is installed. In a solid bottomrail such as is shown in FIG. 3 a horizontal channel 12 is provided through the sides 11 of the bottomrail 10 and communicates with the opening 14. If the bottomrail is hollow horizontal channel 12 would simply be a hole in the front face or rear face of the bottomrail. The lift cords 46, 47 are inserted through the horizontal channel 12 and attached to the insert 20. The insert 20, as shown best in FIGS. 4 through 6, has a post portion 28 which communicates with the horizontal channel 12. As shown most clearly in FIGS. 4 and 5, the insert has radially spaced ribs 29 each having a tapered top which extend from the post portion 28. These ribs create a friction fit of the insert into the opening in the bottomrail and define channels through which the rails of the ladder pass. An opening 22 is provided in the post portion 28 for attaching the end of the lift cord such as by tying the lift cord to the post portion 28 or simply threading the lift cord through the opening 22 and then tying a knot in the end so that it cannot be pulled back through. Alternatively, a single lift cord could be routed from the headrail, through slots in the front edge of the slats, through the horizontal channel 12 and opening 22 and up to the headrail through slats in the back edge of the slats. The cord rails 44 are also inserted through the horizontal channel 12, but then are routed along the sides of the insert 20 and out through the opening 14.

Figure 7:
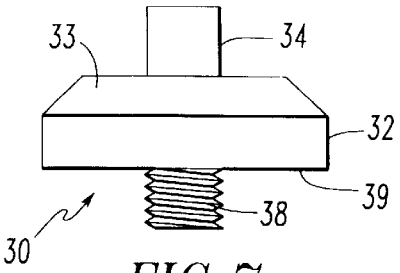
FIG. 7 is a side view of a first present preferred threaded plug.
Figure 8:
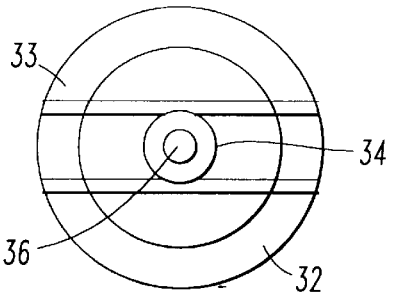
FIG. 8 is a bottom plan view of the threaded plug shown in FIG. 6.

We prefer to provide a rim portion 26 on the insert in which small apertures 27 are provided so that the ends of the cord rails 44 may be passed therethrough. In this manner, the rim 26 of the insert 20 does not clamp the cord rails against the bottomrail 10. Consequently, the cord rails 44 can be pulled through the opening 14 without removing the insert 20. The insert 20 further has an axial bore 24 in the center of the rim portion 26 into which a threaded plug 30 is installed. The threaded plug 30, shown best in FIGS. 7 and 8 has a threaded stud portion 38 which screws into the axial bore 24 of the insert 20. We also prefer to provide a cap portion 32 on the threaded plug 30 which covers the insert 20 when the plug 30 is screwed into the axial bore 24. The cap portion 32 has a clamping surface 39 which closes against the head portion 25 as the threaded plug 30 is screwed down against the insert 20. The threaded plug 30 thereby clamps the cord rails 44 firmly between the clamping surface 39 and the head portion 25 to securely hold the cord rails 44 in place. Moreover, the cap gives the blind 5 more of a "finished" appearance. A tapered surface 33 is provided on the cap portion 32 for more conveniently gripping the threaded plug 30 to screw it into the bore 24 of the insert 20. Additionally, the cap portion preferably has a stem portion 34 and a pocket 36 formed in the stem portion 34. The pocket 36 is provided so that the loose ends of the cord rails 44 can be pushed into the pocket 36 to further give the blind a more finished appearance. If the plug 30 is completely removed from the insert, the plug will be retained on the ladder rails 44 because the ladder rails are in pocket 36. The loose ends of the cord rails 44, after drawing them through the small apertures 27, are routed around the cap portion 32 and stored in the pocket 36. Excess portions of the ladders can also be stored in a cavity between the cap 32 and the inset 20. If desired, the loose ends of the cord rails 44 can be fused together prior to insertion in the pocket 36. The cap portion 32 need only be loosened, not removed to pull the excess rails through the bottomrail.

Figure 9:
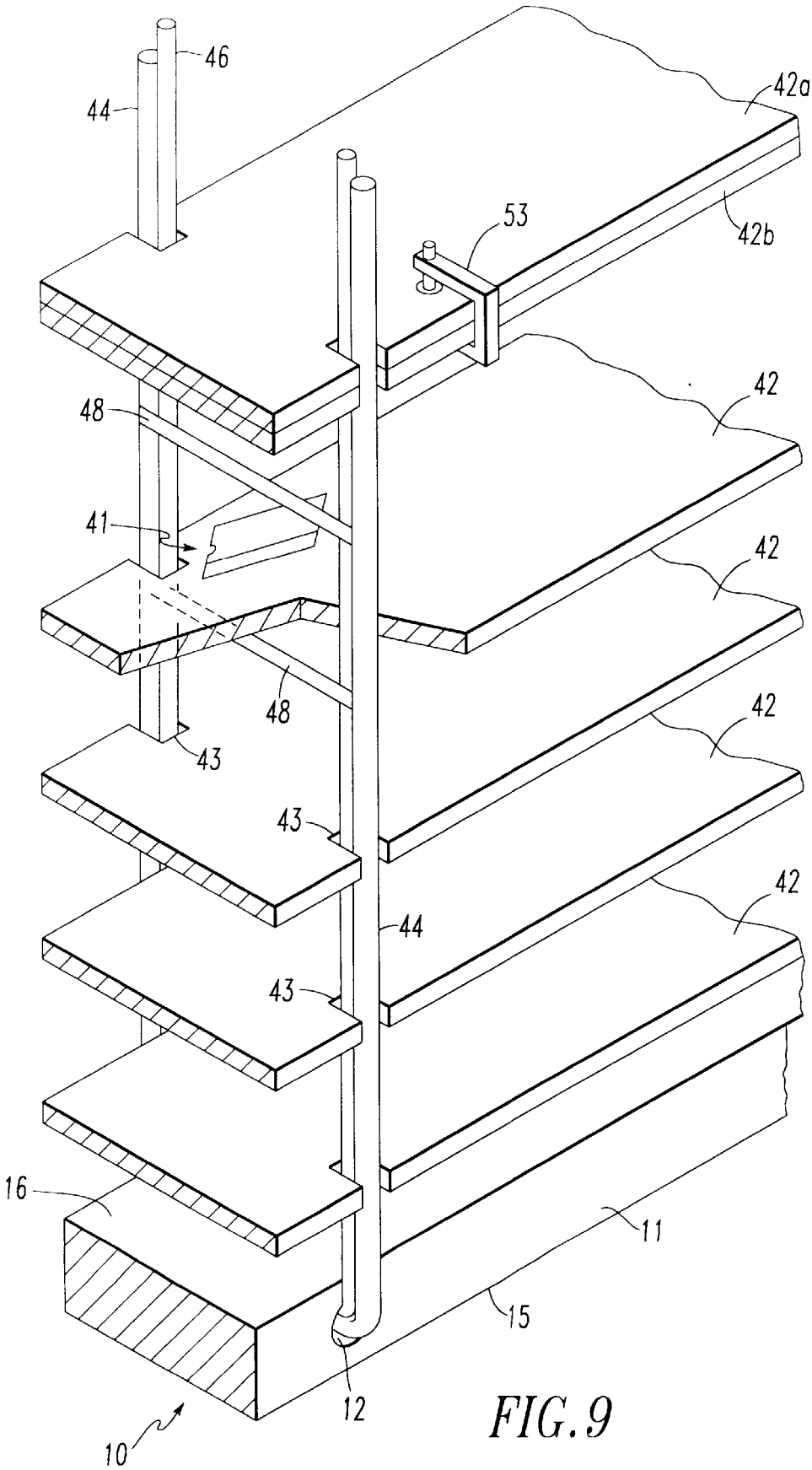
FIG. 9 is a perspective view similar to FIG. 2 illustrating a preferred method for shortening a blind having our bottomrail.

Referring now to FIG. 9, we also provide a method for customizing the length of the a venetian type blind 5 having a length adjustable bottomrail 10 as described previously. According to our presently preferred method, the length of the window in which the blind is to be installed is measured and a standard length blind is initially selected. To create the best appearance, the fully extended length of the blind will be very close to the length of the window. Thus, a standard size blind having a length close to but longer than the window should be selected. Next, to shorten the length of the blind to fit the length of the window, a slat 42*b* nearest the new length for the blind is identified. The slat 42*a* above the selected slat is clamped by clamp 53 to that slat 42*b* so that there are rungs between them. The excess slats 42 below the clamped slats may be removed or preferably the rungs are cut in the middle by pushing the slats askew and aside. Next, the rungs 48 are each cut down the middle with a knife or razor blade 41. Any slats that did fall away during cutting of the rungs are removed. The next step is to pull on the lift cord 46, 47 to raise the bottomrail 10 up to the new length. To get rid of the slack in the cord rails 44 the threaded plug 30 is loosened to unclamp the cord rails 44 from between the threaded plug 30 and the insert 20. The ends of the cord rails 44 can then be pulled to draw the excess slack through the horizontal channel 12 and out through the opening 14 in the bottomrail 10. The threaded plug 30 is then tightened down against the insert 20. The excess slack in the cord rails 44 is cut off. The free ends of the cord rails 44 can be fused together and stored in the pocket 36 in the threaded plug 30 in order to give the blind 5 a finished appearance. Clamping the slats together assures that the rungs between them are not inadvertently cut. If desired this step could be omitted.

Figure 10:
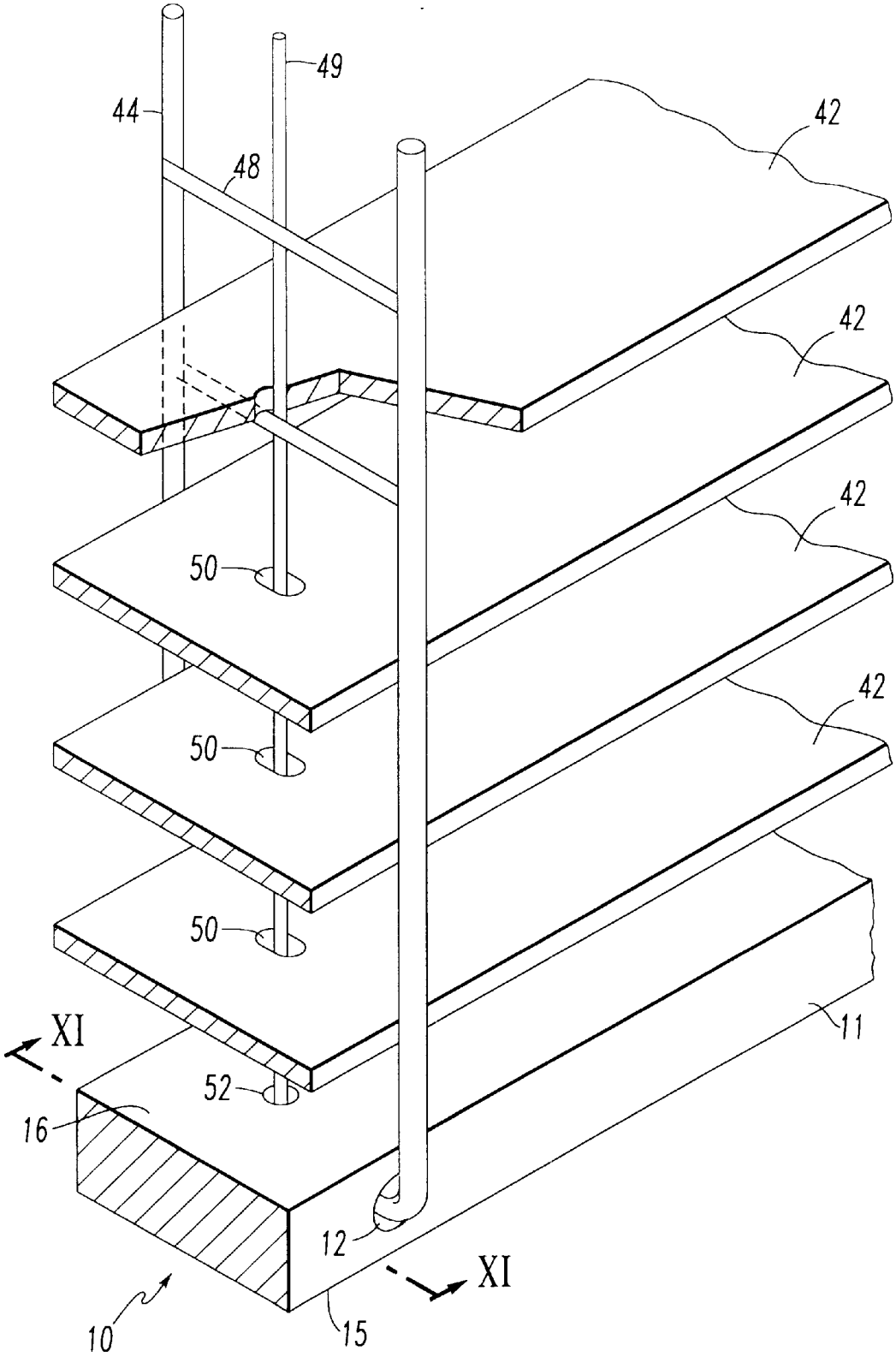
FIG. 10 is a perspective view similar to FIG. 2 except showing a different lift cord arrangement.
Figure 11:
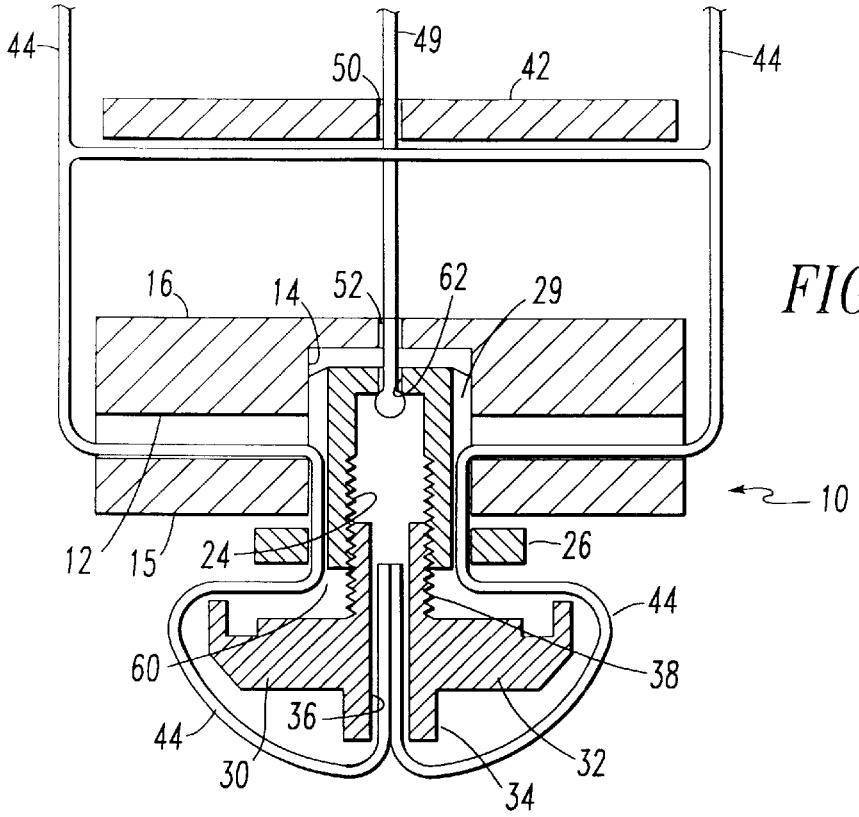
FIG. 11 is a cross sectional view similar to FIG. 3 except showing an the alternate type of insert shown in FIGS. 7 and 8.

Another presently preferred embodiment of the length adjustable bottomrail 10 is shown in FIGS. 10 and 11 wherein the lift cords 49 pass through small openings 50 provided in the middle of each slat 42. In this case, a vertical channel 52 is additionally provided in an upper side 16 of the adjustable bottomrail 10. The lift cord 49 is routed through the vertical channel 52 which communicates with an alternative insert 60 disposed in the opening 14 in the underside of the bottomrail 10. As shown in FIG. 11, the insert 60 additionally has an axial opening 62 through which the lift cord 49 is attached in the same manner previously described in regard to the first insert 20. Although we have shown and described an alternative insert, the previous insert 20 could also be used. The main requirement for blinds having a lift cord which passes through holes in the middle of the slats is that the vertical channel 52 be provided through the upper side 16 of the bottomrail 10 so that the lift cord 49 has access to the plug. Providing the insert 60 having an axial opening 62 merely makes it more convenient to attach the lift cord 49. In other respects, the adjustable bottomrail and the routing of the cord rails 44 can be the same as described in the first presently preferred embodiment.

A method for adjusting a venetian type blind 5 having a length adjustable bottomrail 10 wherein the lift cord 49 passes through the vertical channel 52 in the upper side 16 of the bottomrail 10 is similar to that described above. However, in this type of blind the excess slats are cut near the lift cords for removal. Alternatively, the lift cords could be cut and reconnected to the plugs after the excess slats have been removed. The cord rails 44 are routed through the horizontal channel 12 and out the opening 14 in the same manner as for a venetian type blind 5 wherein the lift cords 46, 47 pass through the horizontal channel 12.

Although we prefer to employ an insert 20, 60 disposed in the opening 14 in the bottomrail 10 with the threaded plug 30 installed in the insert, the insert itself is not necessarily required. The threaded plug 30 could be screwed directly into the opening in the bottomrail without the need for the insert 20, 60. An opening would be provided in the cap for the cord rails to pass.

Figure 12:
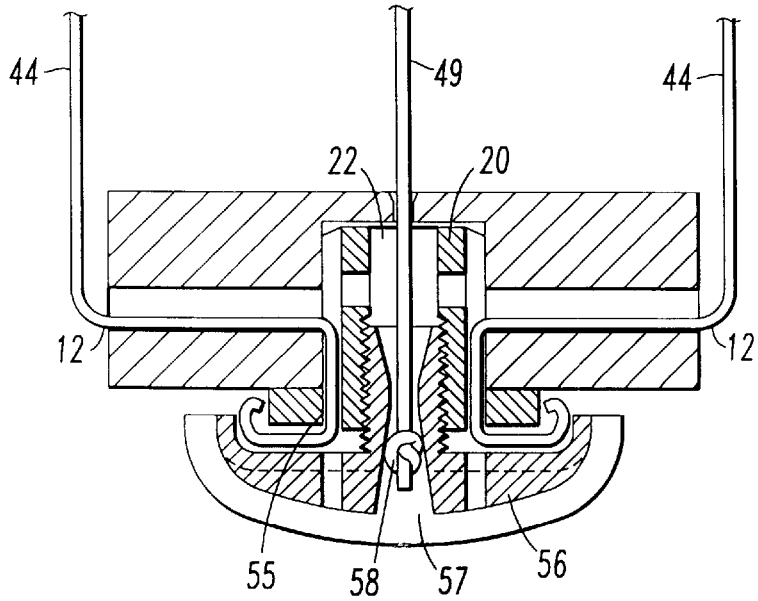
FIG. 12 is a cross sectional view similar to FIG. 11 having a second type of plug.

The bottomrail 10 of the embodiment shown in FIG. 12 has a horizontal channel 12 through which the ladder rails 44 pass as in the embodiment shown in FIG. 2. There is also an insert 20 having a central cavity 22 that extends through the insert. The lower portion 55 of the cavity 22 is threaded to receive a threaded plug 56. That plug is similar to the plug 30 of the previous embodiment except that there is an hourglass passageway 57 through the center of the plug. Lift cord 49 fits through that hourglass cavity and is tied to form a knot 58. To shorten the blind, cord ladders are pulled through the bottomrail after loosening the plug 56 as in the previous embodiments. The lift cord 49 is either untied or cut so that it may pass through the passageway 57 in plug 56 and through the slats to be removed from the blind. After the slats are removed the lift cord 49 is threaded back through the hole 50 in the bottomrail and through the hourglass passageway 57 in the plug 32. Finally, the cord is knotted and thus secured in place.

Figure 13:
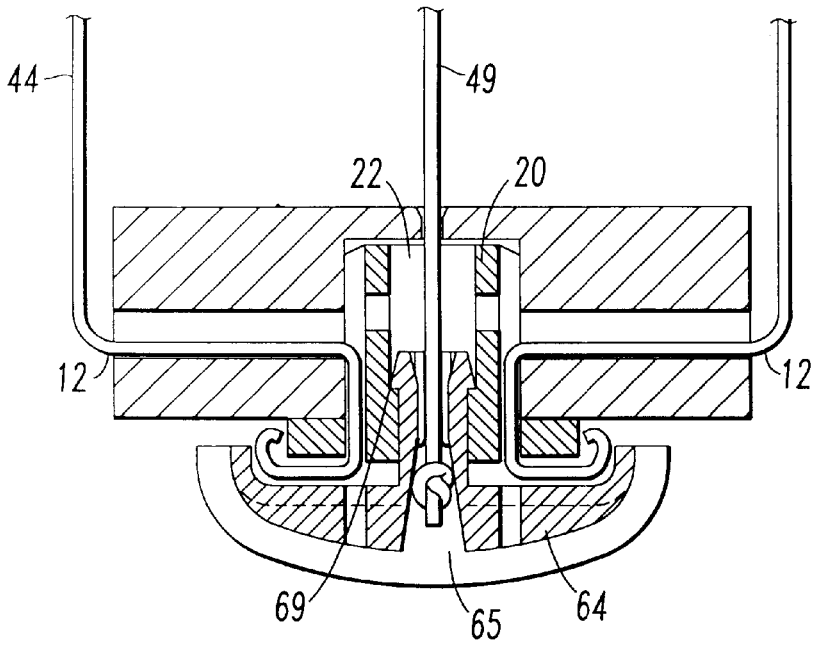
FIG. 13 is a cross sectional view similar to FIG. 12 showing a third plug which is not threaded.
Figure 14:
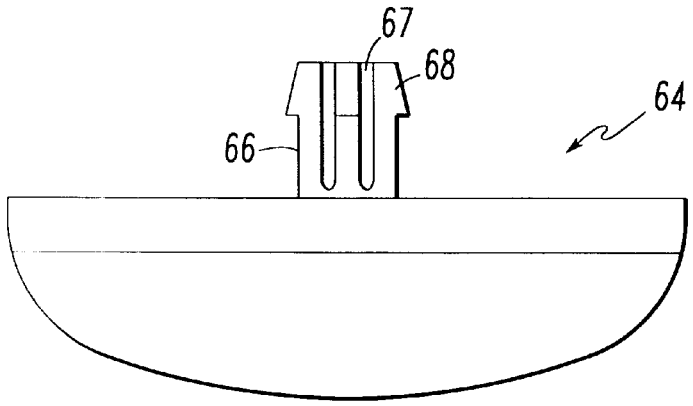
FIG. 14 is a side view of the plug used in the embodiment of FIG. 13.

Yet another plug arrangement which has no threads is shown in FIGS. 13 and 14. That plug 64 fits within a similar type of insert 20 as is used in the previous embodiment. A central cavity 65 is provided through the plug. Lift cord 49 fits through that cavity and has a knot which secures it in place. The plug has a cylindrical portion 66 which has slots 67 cut in the sidewall. An annular shoulder 68 is provided at the distal end of the cylindrical member 66. When the plug 64 is pressed into the cavity 22 of the insert the distal end of the cylindrical portion narrows as the slots close. After the annular collar passes over the shoulder or ledge 69, the end of the cylindrical body expands locking the plug 64 in place.

Figure 15:
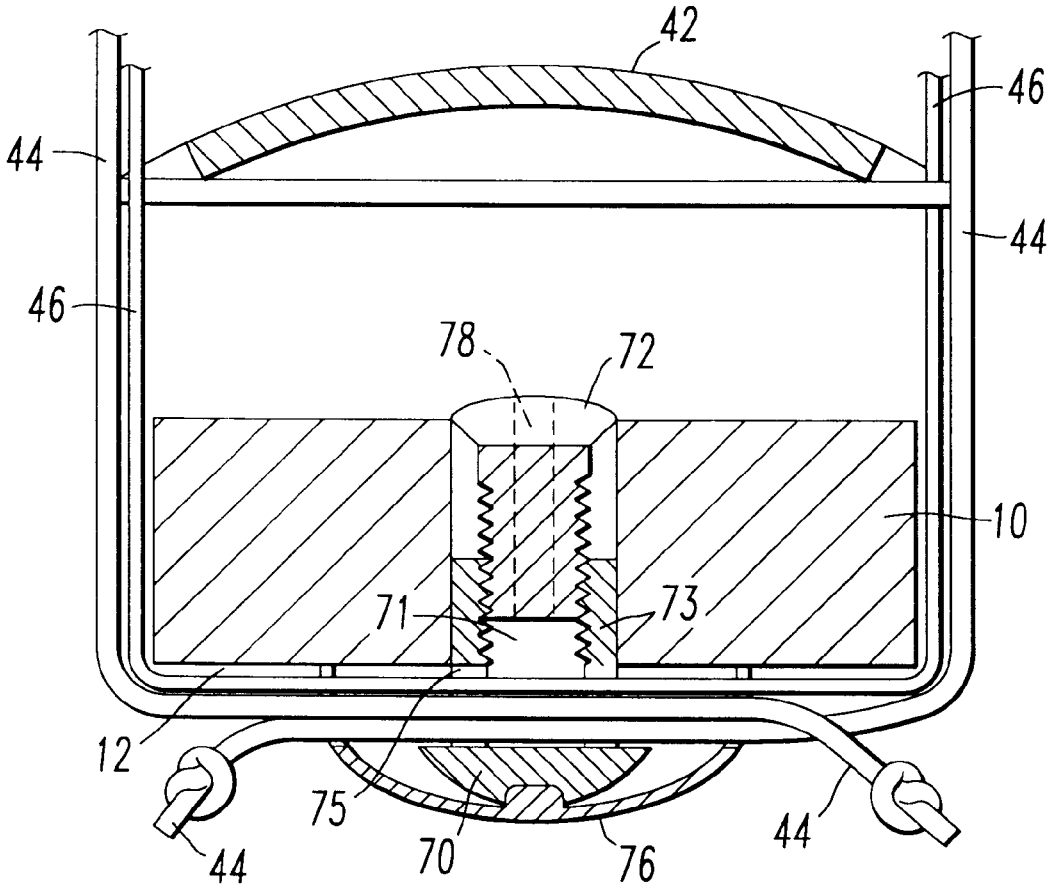
FIG. 15 is a cross sectional view similar to FIG. 10 showing a fourth type plug which is used without an insert.

Another embodiment of a bottomrail for a no holes blind is shown in FIG. 15. That bottomrail 10 also has a hole in the bottom for each ladder. A plug 70 has a tubular body 73 which extends upward through the hole. The center portion 71 of the tubular body 73 is threaded. The plug 70 is held in place by a screw 72 which engages the threads. A transverse slot 75 is cut through the tubular body to allow passage of the ladder rails 44 through that slot. In the embodiment shown a single lift cord extends down the front of the blind through the slot and back up the front of the blind. Tightening the screw 72 moves the plug 70 into the bottomrail closing off the channel 12 through which the ladder rails and lift cord pass and clamps them in place. To shorten the bottomrail one clamps two slat together at the desired length and cuts the rungs as previously described. The one loosens the cap and pulls the ladder rails through the slot. When the desired length has been reached the cap is tightened clamping the ladders against the bottomrail. Then, the excess ladder rails are cut away. A cap 76 is snap fit onto the plug. Alternatively, a central cavity 78 shown in dotted line can be drilled through the screw. The excess portions of the ladder rails can then be threaded through the cavity 78 and cut off flush with the top of the screw 72. Although the embodiment shown in FIG. 15 has a single cord which functions as both the front lift cord and the back lift cord, two lift cords could be used. One could also use the alternate cording arrangement wherein one lift cord is provided at each ladder and adjacent lift cords are alternately along the front of the slats and along the rear of the slats. The bottom end of those cords would pass into the slot and be secured as previously described. The free ends of the lift cords could then be maintained in a cavity 78 provided through the screw 72 or under the cap 76.

Although we have shown and described certain present preferred embodiments of our length adjustable bottomrail and method for adjusting the length of a venetian type blind, it should be distinctly understood that the invention is not limited thereto but may be variously embodied within the scope of the following claims.

We claim:

1. A method of adjusting a length of a venetian type blind to a desired new length with a length adjustable bottomrail wherein the venetian blind has a bottomrail, a headrail above the bottomrail, a plurality of slats between the headrail and the bottomrail, ladder cords connected between the bottomrail and the headrail and having opposite cord rails and rungs extending therebetween which carry the slats, and lift cords connected between the bottomrail and headrail the method comprising:

a. selecting a blind having a length longer than a desired new length;

b. identifying a slat at the desired new length;

c. removing those slats between the identified slat and the bottomrail to create a plurality of empty rungs;

d. cutting the empty rungs;

e. pulling the lift cords to raise the bottomrail to the desired new length;

f. loosening connections of the ladders to the bottomrail;

g. pulling the cord rails out through the bottomrail; and h. tightening the connections of the ladders to the bottomrail.

2. The method of claim 1, further comprising cutting portions of the ladders.

3. The method of claim 1 wherein the bottomrail has at each ladder location a cap containing a pocket and further comprising storing loose ends of the cord rails of each selected ladder in the pocket provided in the cap.

4. A method of adjusting a length of a venetian type blind with a length adjustable bottomrail wherein the venetian blind has a bottomrail, a headrail above the bottomrail, a plurality of slats between the headrail and the bottomrail, ladder cords connected between the bottomrail and the headrail and having opposite cord rails and rungs extending therebetween which carry the slats, and lift cords connected between the bottomrail and headrail the method comprising:

a. selecting a blind having a length longer than a desired new length;

b. identifying a slat at the desired new length;

c. clamping two slats together at the desired new length;

d. removing excess slats between the identified slat and the bottomrail to create a plurality of empty rungs;

e. cutting the empty rungs;

f. pulling the lift cords to raise the bottomrail to the desired new length;

g. loosening connections of the ladders to the bottomrail;

h. pulling the cord rails out through the bottomrail; and i. tightening the connections of the ladders to the bottomrail.

5. A method of adjusting a length of a venetian type blind with a length adjustable bottomrail wherein the venetian blind has a bottomrail, a headrail above the bottomrail, a plurality of slats between the headrail and the bottomrail, ladder cords connected between the bottomrail and the headrail and having opposite cord rails and rungs extending therebetween which carry the slats, and lift cords connected between the bottomrail and headrail wherein the bottomrail has a threaded plug connected to the bottomrail at each ladder which threaded plug releasably screws the rails of a ladder to the bottomrail, the method comprising:

a. selecting a blind having a length longer than a desired new length;

b. identifying a slat at the desired new length;

c. removing excess slats between the identified slat and the bottomrail to create a plurality of empty rungs;

d. cutting the empty rungs;

e. pulling the lift cords to raise the bottomrail to the desired new length;

f. loosening connections of the ladders to the bottomrail;

g. pulling the cord rails out through the bottomrail; and h. tightening the connections of the ladders to the bottomrail.

* * * * *